United States Patent [19]

Inoue

[11] Patent Number: 4,967,972

[45] Date of Patent: Nov. 6, 1990

[54] SEPARATOR FOR SEPARATING PROCESSED MATERIAL FROM GRINDING MEDIUM

[75] Inventor: Masakazu Inoue, Tokyo, Japan

[73] Assignee: Inoue Seisakusho (MFG) Co., Ltd., Japan

[21] Appl. No.: 148,573

[22] Filed: Jan. 26, 1988

[30] Foreign Application Priority Data

Jan. 26, 1987 [JP] Japan ..... 8638[U]

[51] Int. Cl.[5] ..... B02C 17/16

[52] U.S. Cl. ..... 241/171; 241/172

[58] Field of Search ..... 241/171, 172, 69; 209/233, 660

[56] References Cited

U.S. PATENT DOCUMENTS 4,382,557 5/1983 Duerr ..... 241/172 X

FOREIGN PATENT DOCUMENTS 990299 2/1983 U.S.S.R. ..... 241/172

*Primary Examiner*—Mark Rosenbaum

*Attorney, Agent, or Firm*—Bruce L. Adams; Van C. Wilks

[57] ABSTRACT

A dispersing and grinding apparatus disperses and grinds material by the use of a particulate grinding medium. A separator installed at the discharge end of the apparatus separates the processed material from the grinding medium. The separator comprises a stationary stator, and a rotatable rotor mounted so that the rim area of the rotor is spaced from and faces the stator to define therebetween a small gap which is large enough to permit the processed material to pass therethrough though small enough to prevent the grinding medium from passing therethrough. The rotor has a plurality of protruding portions which extend radially outwardly from the rotor and which effectively centrifugally disperse the grinding medium which tends to collect and concentrate at the rim area of the rotor. The protruding portions are removably fastened to the rotor, either as separate protruding members or as part of a one-piece structure, so that the protruding portions can be removed and replaced as they become worn. By such a construction, the useful life of the rotor is significantly prolonged because the grinding medium is positively centrifugally dispersed away from the rim area of the rotor by the protruding portions and the protruding portions, when worn, can be removed and replaced without the need of replacing the rotor.

17 Claims, 2 Drawing Sheets

SEPARATOR FOR SEPARATING PROCESSED MATERIAL FROM GRINDING MEDIUM

BACKGROUND OF THE INVENTION (1) Field of the Invention

The present invention relates generally to separators for separating processed material from a grinding medium in a dispersing and grinding apparatus and more particularly, to a separator having dispersing means for centrifugally dispersing the grinding medium which tends to accumulate at the region where the separated processed material exits from the apparatus.

(2) Background Information

Dispersing and grinding apparatus are in widespread use for dispersing, grinding and agitating various types of materials. These apparatus are commonly known as dispersion agitators or grinding mills and utilize a grinding medium, such as balls, beads or other particulates to accomplish the grinding and comminuting action. After the material is suitably dispersed, ground and agitated, the processed material must be separated from the grinding medium. For this purpose, a separator is frequently installed at the discharge end of the apparatus for separating the processed material from the grinding medium such that the processed material is discharged from the apparatus while the grinding medium is retained in the apparatus for re-use.

One common type of separator is the so-called dynamic separator which comprises a stationary stator and a rotatable rotor. The stator and rotor are spaced apart a slight distance so that a small gap exists between the rims of the rotor and the stator to define a discharge passage for the processed material. The size of the gap is smaller than the size of the particulates which constitute the grinding medium thereby ensuring that the grinding medium cannot pass through the gap.

One drawback of such separators is that the stator, the rotor, or both, become quickly abraded by the grinding medium and, therefore, need frequent replacement. This is due to the fact that the grinding medium tends to accumulate and concentrate at the rim area of the rotor so that as the rotor rotates, the grinding medium abrades and wears out the confronting surfaces of the stator and rotor. Various attempts have been made to solve this problem though none has proved successful. For example, it has been proposed to configure the rotor in an elliptical shape to reduce the concentration of the grinding medium at the rim area of the rotor. It has also been proposed to mount the rotor eccentrically relative to the stator so that as the rotor rotates, the relative positions of the rim areas of the rotor and the stator constantly change so as to avoid the concentration of the grinding medium at the rim area of the rotor. These prior art attempts are disclosed, for example, in U.S. Pat. No. 4,534,516. However, these prior art separators do not prevent rapid wearing out of the rotor because the periphery of the rotor itself is used to push the grinding medium outwardly. Hence, the rotor rapidly becomes worn and requires frequent replacement. Moreover, when it becomes necessary to replace the rotor in the prior art separators, it is usually necessary to remove and replace the entire rotor assembly, and such a task is both troublesome and uneconomical.

SUMMARY OF THE INVENTION

One object of the present invention is to provide a separator for separating processed material from a grinding medium in a dispersing and grinding apparatus and which effectively centrifugally disperses the grinding medium which tends to accumulate at the region where the separated processed material exits from the apparatus.

Another object of the present invention is to provide a separator comprised of a stator and rotor and which has dispersing means on the rotor for centrifugally dispersing the grinding medium which tends to concentrate at the rim area of the rotor.

A further object of the present invention is to provide a separator comprised of a stator and rotor and which has protruding portions removably attached to the rotor for centrifugally dispersing the grinding medium which tends to collect at the rim area of the rotor thereby enabling removal and replacement of the protruding portions when they become worn out.

A still further object of the present invention is to provide a separator which is rugged and durable in construction and which has a longer useful life than comparable prior art separators.

These as well as other objects, features and advantages of the invention are achieved by a separator comprised of a stationary stator, and a rotor mounted so that the rim area of the rotor is spaced from and faces the stator to define therebetween a small gap which is large enough to permit the processed material to pass therethrough though which is small enough to prevent the grinding medium from passing therethrough. The rotor is provided with a plurality of protruding portions which extend radially outwardly from the rotor and which effectively centrifugally disperse the grinding medium which tends to collect and concentrate at the rim area of the rotor. The protruding portions are removably fastened to the rotor, either as separate protruding members or as part of a one-piece structure, so that the protruding portions can be removed and replaced as they become worn. By such a construction, the useful life of the rotor is significantly prolonged because the grinding medium is positively centrifugally dispersed away from the rim area of the rotor by the protruding portions and because the protruding portions, when worn, can be removed and replaced without the need of also replacing the rotor.

The aforementioned objects, features and advantages of the present invention, as well as others, will become more readily apparent to persons of ordinary skill in the art upon a reading of the following description of the invention when read in conjunction with the accompanying drawings.

DESCRIPTION OF THE PREFERRED EMBODIMENTS

The separator of the present invention may be used with either a horizontal- or vertical-type dispersing and grinding apparatus. In the following description reference will be made to the vertical-type apparatus, and it is understood that the separator of the invention is equally applicable for use with a horizontal-type dispersing and grinding apparatus.

Figure 1:
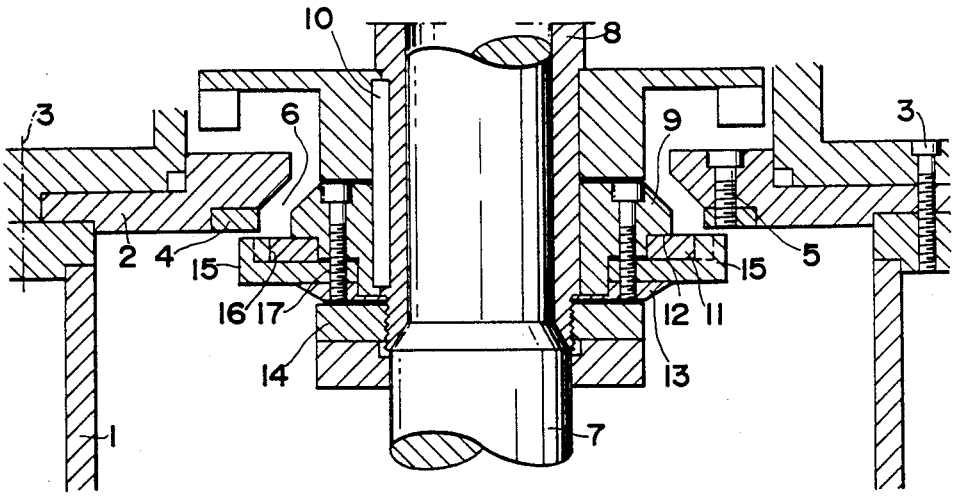
FIG. 1 is a longitudinal sectional view of one embodiment of a separator for separating processed material from a grinding medium constructed according to the principles of the present invention.

FIG. 1 shows one embodiment of a separator installed in a vertical-type dispersing and grinding apparatus. The apparatus includes a vertically disposed grinding vessel 1 which contains means (not shown) for admitting a material to be processed. Also contained within the grinding vessel 1 is a grinding medium (not shown) which may comprise balls, beads, or other suitable particulates. The particular grinding medium does not constitute part of the present invention, and its choice will depend on the nature of the material being processed and the kind of processing to be done. An agitator (not shown) is rotatably disposed within the grinding vessel 1 and functions in a manner well known in the art to disperse, grind and agitate the material by the cooperative actions of the rotating agitator and the grinding medium. As the agitator rotates, the material contained within the grinding vessel 1 is uniformly mixed, dispersed and ground by the grinding medium, and the thus processed material is progressively advanced upwardly toward the upper end of the grinding vessel 1.

The separator is installed at the upper portion of the grinding vessel 1 and comprises a stationary stator assembly and a rotatable rotor assembly. The stator assembly comprises a flange 2 removably attached to the grinding vessel 1 by means of fastening bolts 3. The flange 2 is provided with an annular recess, and an annular, ring-shaped stator 4 is disposed within the flange recess and removably secured to the flange 2 by fastening bolts 5.

The inner periphery of the flange 2 and the stator 4 define an outlet 6 for the discharge of the processed material from the grinding vessel 1. A rotary shaft 7 extends through the outlet 6 downwardly into the grinding vessel 1 and rotationally carries the agitator (not shown). During use of the apparatus, the rotary shaft 7 is rotationally driven by means (not shown) to accordingly rotate the agitator which disperses, grinds and agitates the material within the grinding vessel 1 in conjunction with the grinding medium.

The rotor assembly comprises a support member 9 which is removably secured to the rotary shaft 7 to undergo rotation therewith by means of a key-and-groove connection. The key-and-groove connection comprises a sleeve 8 secured to the rotary shaft 7, and a key 10 inserted into a pair of opposed grooves formed in the sleeve 8 and the support member 9. In this manner, the rotation of the rotary shaft 7 is transmitted through the keyed connection to the support member 9. An annular recess 12 is formed around the periphery of the support member 9, and a rotor 11 of generally circular shape is mounted in the recess 12 and extends radially outwardly of the support member 9. A back plate 13 is provided on the underside of the support member 9 and engages with the underside of the rotor 11 to secure the rotor to the support member 9. A set of fastening bolts 17 are used to fasten together the support member 9, the rotor 11 and the back plate 13 to thereby define the rotor assembly. A threaded nut 14 is threaded onto the lower end of the sleeve 8 in order to set and maintain the axial position of the rotor assembly relative to the rotary shaft 7.

Figure 2:
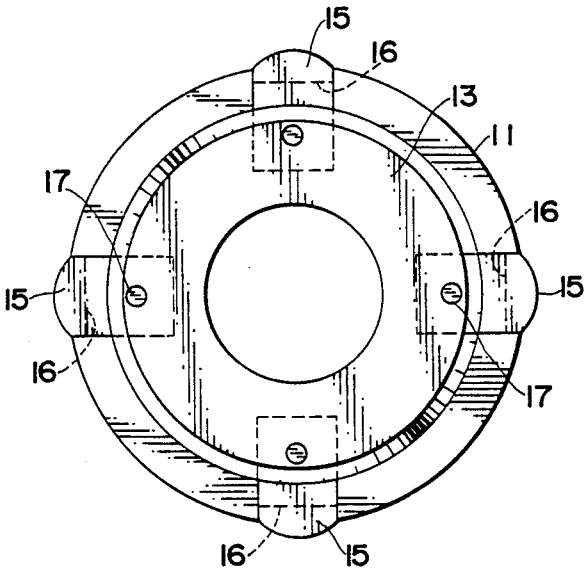
FIG. 2 is a bottom plan view of the rotor assembly shown in FIG. 1.

The rotor 11 is provided with a plurality of circumferentially spaced-apart protruding portions 15 which extend radially outwardly from the periphery of the rotor 11. In this embodiment, the protruding portions 15 comprise separate projecting members 15. Each projecting member 15 has a radially extending base portion which extends into an opening in the support member 9 between the rotor 11 and the back plate 13, and a tip portion connected to the outer end of the base portion and extending upwardly flush with the upper surface of the rotor 11. As shown in FIGS. 1 and 2, the rotor 11 has a plurality of peripheral grooves 16 into which extend the tip portions of the protruding members 15. The protruding members 15 are removably engaged in respective ones of the rotor grooves 16 and are removably fastened to the support member 9 by means of the bolts 17. As shown in FIG. 2, which is a bottom plan view of the rotor assembly, the tip portions of the protruding members 15 extend radially outwardly from the periphery of the rotor 11, and the outermost ends of the protruding members have an arcuate shape. The radius of curvature of the arcuate ends of the protruding members is smaller than that of the circular periphery of the rotor 11. In this embodiment, the rotor 11 is provided with four protruding portions 15; however, in accordance with the principles of the invention, the number of protruding portions may be more or less than four.

As shown in FIG. 1, when the separator is installed on a dispersing and grinding apparatus, an upper surface portion of the rotor 11 is axially spaced from and faces an under surface portion of the stator 4 to define a small gap between the rotor 11 and the stator 4. The small gap is suitably dimensioned to permit the processed material to flow therethrough and be discharged from the grinding vessel 1 but is too small to permit the passage therethrough of the grinding medium. The gap spacing may be selectively varied, depending on the size of the particular grinding medium, by adjusting the axial position of this rotor assembly relative to the stator assembly. When the relative positions of the stator 4 and the rotor 11 are selected and set, the gap spacing will be too small to permit the grinding medium to fit therethrough so that only the processed material will exit through the gap and be discharged through the outlet 6. The protruding portions 15 extend radially outwardly of the rim area of the rotor 11 and, as explained in more detail hereinafter, comprise dispersing means for centrifugally dispersing the grinding medium which tends to gather and accumulate at the rim area of the rotor.

During operation of the dispersing and grinding apparatus, material to be processed and a suitable grinding medium are charged into the grinding vessel 1. The rotary shaft 7 is rotationally driven to rotate the agitator to disperse, grind and agitate the material by the cooperative actions of the agitator and the grinding medium. As the processing proceeds, the processed material advances upwardly in the grinding vessel 1 toward the upper end of the vessel. As the processing continues, processed material passes through the small gap between the underside of the stator 4 and the upper side of the rotor 11 whereas the grinding medium is too large to fit through the gap and remains in the grinding vessel 1. In this manner, the separator effectively separates the processed material from the grinding medium.

During the processing and discharging of the processed material, the processed material and the grinding medium progressively accumulate at the rim area of the rotor 11. The processed material exits through the small gap whereas the grinding medium concentrates at the rim area of the rotor 11 at the entrance to the gap. If the grinding medium were not continually removed from the rim area of the rotor, the grinding medium would rapidly abrade the surfaces of the stator 4 and the rotor 11 thereby rapidly wearing out the stator and rotor. The dispersing means 15 effectively prevents this problem by positively dispersing the grinding medium radially outwardly away from the rim area of the rotor 11. The protruding portions 15 are carried by the rotor 11 so that as the rotor 11 rotates, the protruding portions 15 likewise rotate and centrifugally disperse the grinding medium away from the confronting peripheral surface portions of the stator 4 and the rotor 11. The protruding portions 15 exert a centrifugal force on the grinding medium located in the region of the rim area of the rotor, the centrifugal force being effective to disperse the grinding medium radially outwardly. By such a construction, the grinding medium is prevented from accumulating and concentrating at the rim area of the rotor thereby greatly diminishing the abrading of the rotor and stator surfaces and greatly prolonging the useful life of the separator. Moreover, since the grinding medium is dispersed radially outwardly by the protruding portions 15, there is no accumulation of the grinding medium at the rim area of the rotor 11 thereby minimizing the wearing and abrading of the protruding portions 15.

Over long periods of use, the protruding portions 15 will become worn and require replacement. This can be easily done by simply removing the rotor assembly from the apparatus, removing the bolts 17 and removing and replacing the worn protruding members 15 with new ones. In accordance with the invention, as the protruding members 15 will wear out much more quickly than the stator 4 and the rotor 11, it is necessary to replace only the worn protruding members 15. This greatly prolongs the useful life of the stator 4 and the rotor 11 as compared to the prior art separators of this general type.

Figure 3:
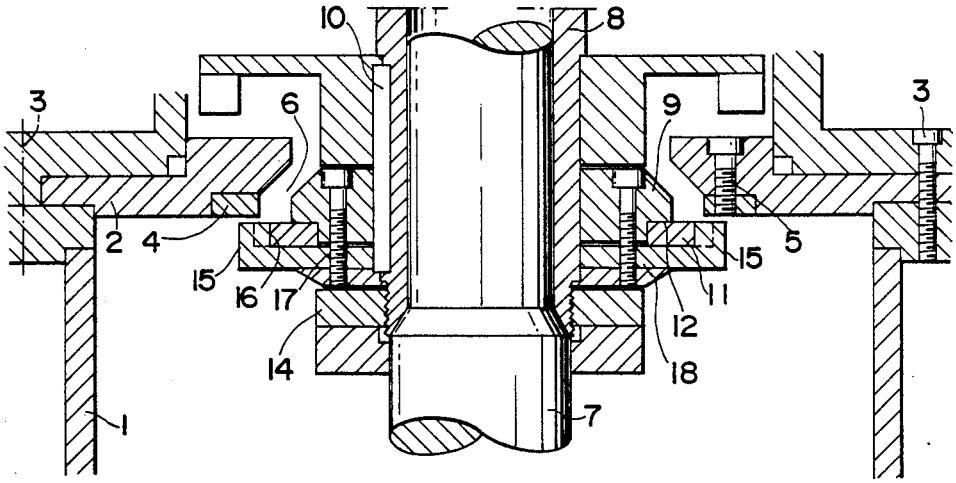
FIG. 3 is a longitudinal sectional view of another embodiment of a separator for separating processed material from a grinding medium constructed according to the principles of the present invention.
Figure 4:
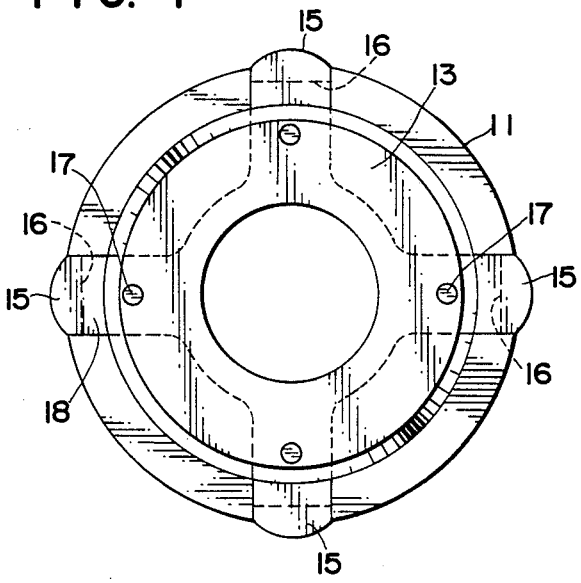
FIG. 4 is a bottom plan view of the rotor assembly shown in FIG. 3.

FIGS. 3–4 show another embodiment of a separator constructed according to the principles of the present invention. This embodiment is the same as that shown in FIGS. 1–2 except for the dispersing means. For ease of understanding, the same reference characters are used in FIGS. 3–4 to denote parts which are the same as those shown in FIGS. 1–2. In the embodiment of FIGS. 3–4, the dispersing means comprises a one-piece structure comprised of a base plate 18 having radially outwardly extending arms which terminate at their outer ends in projecting portions 15. The base plate 18 is removably attached to the support member 9 by means of the bolts 17. In this embodiment, the base plate 18 together with the protruding portions 15 can be removed and replaced as a unit when the protruding portions 15 wear out. While FIG. 4 shows a base plate having four arms terminating in four protruding portions 15, the number of arms and protruding portions may be less than or more than four. In all other respects, the embodiment shown in FIGS. 3–4 is the same as that shown in FIGS. 1–2.

Obvious modifications and changes can be made to the embodiments described above without departing from the spirit and scope of the invention. For example, the rotor assembly can be connected directly to the rotary shaft 7, if desired, without using the sleeve 8. Fastening means other than bolts can be used to releasably fasten and connect together the parts of the rotor and stator assemblies.

As described above, the separator of the present invention greatly prolongs the useful life of the stator and rotor by effectively preventing an accumulation and concentration of the grinding medium in the region of the rim area of the rotor. This is achieved by providing protruding portions on the rotor to centrifugally disperse the grinding medium away from the confronting surfaces of the stator and rotor. When the protruding portions become worn and require replacement, only the worn out protruding portions need be replaced, and it is not necessary to also replace the stator and rotor. The separator of the invention is, therefore, more economical to operate and more simple to maintain and service than comparable prior art separators.

What is claimed is:

1. A separator for use with a dispersing and grinding apparatus of the type which disperses and grinds material by means of a grinding medium and discharges the processed material, the separator comprising: a stationary stator having a central opening therein defining an inner diameter and having an underside; a rotatable rotor having an outer diameter slightly larger than the inner diameter of the stator and having an upper side; means for rotatably mounting the rotor in coaxial relation with the stator such that the upper side of the rotor is axially spaced from and faces the underside of the stator to define a small gap therebetween for the discharge of processed material, the axial spacing of the gap being sufficiently small to prevent the grinding medium from passing therethrough; dispersing means carried by the rotor to undergo rotation therewith and extending radially outwardly of the rotor adjacent the entrance to the gap for centrifugally dispersing grinding medium which tends to accumulate at the entrance to the gap during use of the separator, the dispersing means comprising a plurality of circumferentially spaced-apart protruding portions extending radially outwardly from the periphery of the rotor, the radial outermost ends of the protruding portions having an arcuate shape; and fastening means detachably fastening the dispersing means to the rotor to enable detachment of the dispersing means from the rotor and replacement thereof when the dispersing means becomes worn through use.

2. A separator according to claim 1; wherein the outer periphery of the rotor has a generally circular shape, and the radius of curvature of the arcuate protruding portion ends is smaller than that of the circular outer periphery of the rotor.

3. A separator according to claim 1; wherein the rotor has a plurality of peripheral grooves in which are removably engaged respective ones of the protruding portions.

4. A separator according to claim 1; wherein the plurality of protruding portions comprise a plurality of separate projecting members; and the fastening means includes means for individually removably fastening the projecting members to the rotor to thereby enable individual removal and replacement of the projecting members.

5. A separator according to claim 1; wherein the plurality of protruding portions comprise the ends of the arms of a one-piece base plate; and the fastening means includes means for removably fastening the base plate to the rotor to thereby enable removal and replacement of the base plate and all of the protruding portions together as a unit.

6. A separator according to claim 1; wherein the rotor comprises a disc-shaped rotor.

7. An apparatus according to claim 1; including means removably connecting the rotor to the separator to enable removal of the rotor.

8. An apparatus according to claim 1; including means removably connecting the stator to the separator to enable removal of the stator.

9. A separator according to claim 1; wherein only the arcuately-shaped ends of the protruding portions extend radially outwardly of the rotor periphery.

10. In a dispersing and grinding apparatus having a vessel in which a grinding medium disperses and grinds a material to produce processed material: a separator connected to the vessel for separating the processed material from the grinding medium and effecting discharge of the processed material from the vessel, the separator comprising a stationary stator having a central opening therein defining an inner diameter and having an underside, a rotatable rotor having an outer diameter slightly larger than the inner diameter of the stator and having an upper side, means for rotatably mounting the rotor in coaxial relation with the stator such that the upper side of the rotor is axially spaced from and faces the underside of the stator to define a small gap therebetween for the discharge of processed material, the axial spacing of the gap being sufficiently small to prevent the grinding medium from passing therethrough, dispersing means carried by the rotor to undergo rotation therewith and extending radially outwardly of the rotor adjacent the entrance to the gap for centrifugally dispersing grinding medium which tends to accumulate at the entrance to the gap during use of the apparatus, the dispersing means comprising a plurality of circumferentially spaced-apart protruding portions extending radially outwardly from the periphery of the rotor, the radial outermost ends of the protruding portions having an arcuate shape, and fastening means detachably fastening the dispersing means to the rotor to enable detachment of the dispersing means from the rotor and replacement thereof when the dispersing means becomes worn through use.

11. A dispersing and grinding apparatus according to claim 10; including connecting means for removably connecting the separator to the vessel to thereby enable removal and servicing of the separator.

12. A dispersing and grinding apparatus according to claim 10; wherein the rotor has a plurality of peripheral grooves in which are removably engaged respective ones of the protruding portions.

13. A dispersing and grinding apparatus according to claim 12; wherein the plurality of protruding portions comprise a plurality of separate projecting members; and the fastening means includes means for individually removably fastening the projecting members to the rotor to thereby enable individual removal and replacement of the projecting members.

14. A dispersing and grinding apparatus according to claim 12 wherein the plurality of protruding portions comprise the ends of arms of a one-piece base plate; and the fastening means includes means for removably fastening the base plate to the rotor to thereby enable removal and replacement of the base plate and all of the protruding portions together as a unit.

15. A dispersing and grinding apparatus according to claim 10; wherein the rotor comprises a disc-shaped rotor.

16. An apparatus according to claim 10; including means removably connecting the rotor to the separator to enable removal of the rotor.

17. An apparatus according to claim 10; including means removably connecting the stator to the separator to enable removal of the stator.

* * * * *